US007841353B2

(12) United States Patent
Lee

(10) Patent No.: US 7,841,353 B2
(45) Date of Patent: Nov. 30, 2010

(54) FOLDABLE WALKING STICK WITH ADJUSTABLE LENGTH AND A SHOCK-PROOFING MECHANISM

(76) Inventor: Ming-Hsien Lee, Village Dong-Fang, ShaTou, Chang-an Town, Dongguan City, Guang Dong Province (CN)

( * ) Notice: Subject to any disclaimer, the term of this patent is extended or adjusted under 35 U.S.C. 154(b) by 0 days.

(21) Appl. No.: 12/370,473

(22) Filed: Feb. 12, 2009

(65) Prior Publication Data

US 2010/0200032 A1 Aug. 12, 2010

(51) Int. Cl.
*A45B 9/00* (2006.01)

(52) U.S. Cl. ..... 135/74; 135/75; 135/82

(58) Field of Classification Search ..... 135/65, 135/72, 74, 825, 82; 280/819, 823
See application file for complete search history.

(56) References Cited

U.S. PATENT DOCUMENTS

| | | | | |
|---|---|---|---|---|
| 2,705,015 | A * | 3/1955 | Langlais | 52/632 |
| 3,635,233 | A * | 1/1972 | Robertson | 135/71 |
| 3,669,133 | A * | 6/1972 | Hyman | 135/74 |
| 3,730,544 | A * | 5/1973 | Hyman | 280/819 |
| 3,963,037 | A * | 6/1976 | Clark | 135/65 |
| 4,869,280 | A * | 9/1989 | Ewing | 135/69 |
| 5,775,021 | A * | 7/1998 | Weiss | 42/95 |
| 6,254,134 | B1 * | 7/2001 | Panizza | 280/819 |
| 6,516,821 | B1 * | 2/2003 | Uemura | 135/75 |
| 6,557,572 | B2 * | 5/2003 | Lah | 135/114 |
| 6,745,785 | B2 * | 6/2004 | Kotovsky | 135/65 |
| RE38,635 | E * | 10/2004 | Uemura | 135/69 |
| 7,025,072 | B2 * | 4/2006 | McGrath | 135/75 |
| 7,104,271 | B2 * | 9/2006 | Larson et al. | 135/73 |
| 2005/0150532 | A1 * | 7/2005 | Lin | 135/75 |

FOREIGN PATENT DOCUMENTS

JP 2007014395 A * 1/2007

* cited by examiner

*Primary Examiner*—Winnie Yip
(74) *Attorney, Agent, or Firm*—Egbert Law Offices PLLC

(57) ABSTRACT

The present invention provides a foldable walking stick with adjustable length and shock-proofing mechanism. The foldable walking stick includes a rod holder containing at least two interconnected rods and a handle, arranged at an upper part of the foldable stick. Each rod connected to the handle is divided into first and second rod sections, the second rod section having a flexible pulling rope and a flexible locating pin. A plurality of locating holes, are arranged on the wall of the first rod section with different heights, allowing for locking by the flexible locating pin when inserting the second rod section. A tapered locating section is arranged onto the flexible locating pin. An inner space, is arranged onto the preset location of a rod. There is a shock-proofing mechanism, assembled within the inner space; and a grounding portion, arranged at bottom of either rod.

6 Claims, 9 Drawing Sheets

FOLDABLE WALKING STICK WITH ADJUSTABLE LENGTH AND A SHOCK-PROOFING MECHANISM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a foldable walking stick, and more particularly to an innovative walking stick with adjustable length and shock-proofing mechanism.

2. Description of Related Art Including Information Disclosed Under 37 CFR 1.97 and 37 CFR 1.98.

A walking stick is mainly used to support the walkers by maintaining the balance of their bodies and driving the forward movement. To meet diversified user demands, some foldable or extendable walking sticks are developed with a shock-proofing mechanism, enabling it to prevent and reduce the vibration, while being stored and carried easier, depending on the adjustable length.

However, the existing walking stick is adjusted by inserting the second rod section into the hole of the first rod section. The second rod section is provided with a cylindrical locating pin, which has a straight locating section. The first rod section is provided with some locating holes of different heights, allowing for locking by the locating pin when inserting the second rod section.

The following shortcomings are observed during actual applications.

First, the locating pin is of a cylindrical shape, and the protruding locating section is straight, so the external diameter cannot be easily fixed. When this structure is inserted into the locating hole of the first rod section, a gap with the locating hole will lead to swinging motion, noise and poorer performance. In addition, there is a loose joint between the first and second rod sections, leading to poorer stability.

Second, the shock-proof mechanism on the stick is poorly structured such that the components are unstably assembled, leading to failure of shock-proofing.

Thus, to overcome the aforementioned problems of the prior art, it would be an advancement in the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

First, based on the innovative structure of the present invention, the foldable walking stick with adjustable length and a shock-proofing mechanism of the present invention permits the flexible locating pin of the second rod section to be fitted with a tapered locating section for inserting securely into the locating hole of the first rod section in conjunction with O-ring. The head and shock-proofing mechanism are reduced in size. The periphery of the tapered locating section can be airtightly locked into the locating hole, such that two rod sections are stably supported and connected without any noise, helping to realize convenient folding, carrying and assembly/disassembly with improved applicability.

Second, the shock tube is assembled into the inner space of the rod, and the shock lever is flexibly connected to the shock tube via the flexible member, such that the foldable stick of the present invention with shock-proofing mechanism features shock-proofing, ease of operation for a wider range of applications.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
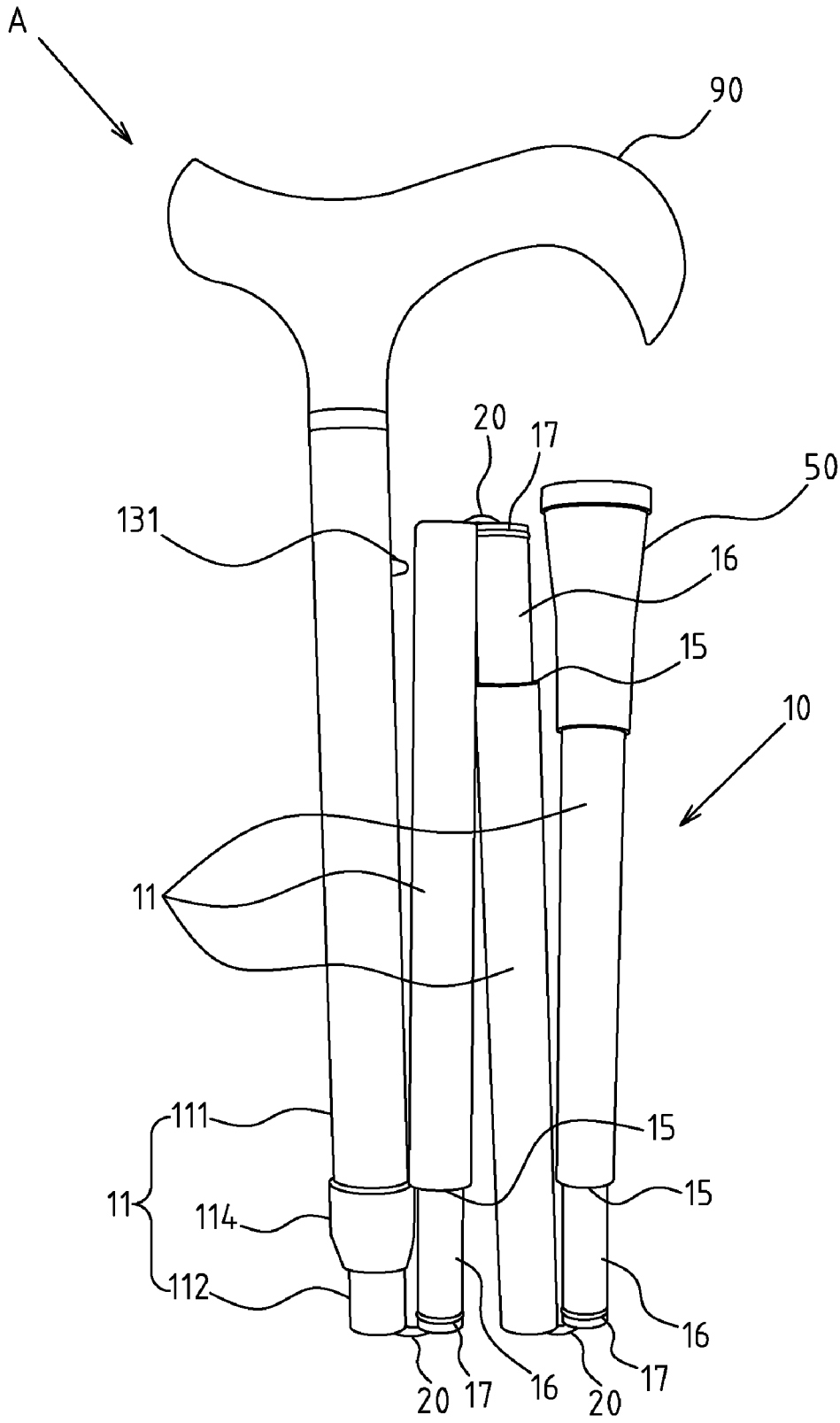
FIG. 1 shows a perspective view of the preferred embodiment of the present invention.

The features and the advantages of the present invention will be more readily understood upon a thoughtful deliberation of the following detailed description of a preferred embodiment of the present invention with reference to the accompanying drawings.

FIGS. 1-4 depict preferred embodiments of a foldable walking stick of the present invention with adjustable length and a shock-proofing mechanism. The embodiments are only provided for explanatory purposes with respect to the claims.

The foldable walking stick A comprises a rod holder 10, containing at least two interconnected rods 11.

There is a handle 90 arranged at upper part of the foldable stick A. The rod 11 connected to the handle 90 is divided into first rod section 111 and second rod section 112.

There is a flexible pulling rope 20, arranged onto the second rod section 112, and used to pull the rod 11 together, allowing to adjust flexibly the length of the first rod section 111 and second rod section 112.

There is also a flexible locating pin 13, arranged on the adapting end of the second rod section 112 in a radially protruding state.

There is also a plurality of locating holes 14, arranged on the wall of the first rod section 111 with different heights, allowing for locking by the flexible locating pin 13 when inserting the second rod section 112.

The invention also includes a tapered locating section 131, arranged on the flexible locating pin 13. The external diameter of the tapered locating section 131 increases gradually from the outside. The maximum diameter of the tapered locating section 131 is bigger than aperture of locating hole 14 of the first rod section 111, thus allowing to insert into the locating hole 14 of the first rod section 111 via the tapered locating section 131.

There is also an inner space 60, arranged onto the preset location of a rod 11.

There is a shock-proofing mechanism 70, assembled within the inner space 60.

A grounding portion 50 is arranged at the bottom of a rod 11.

The rods 11 of the foldable walking stick A are interconnected, namely, the adapting end of either rod 11 is provided with a rod section 16, which is sleeved into the inner wall of the other rod 11. Moreover, a step 15 formed at root of the rod section 16 is braced at the end surface of the other rod 11. The rod section 16 is provided with at least an O-ring 17, enabling the rods 11 to be interconnected stably and tightly. Moreover, the rod section 16 has a good adapting contact to fit the O-ring 17, such that the rod section 16 is mated with the inner wall more closely with an improved stability.

Figure 2:
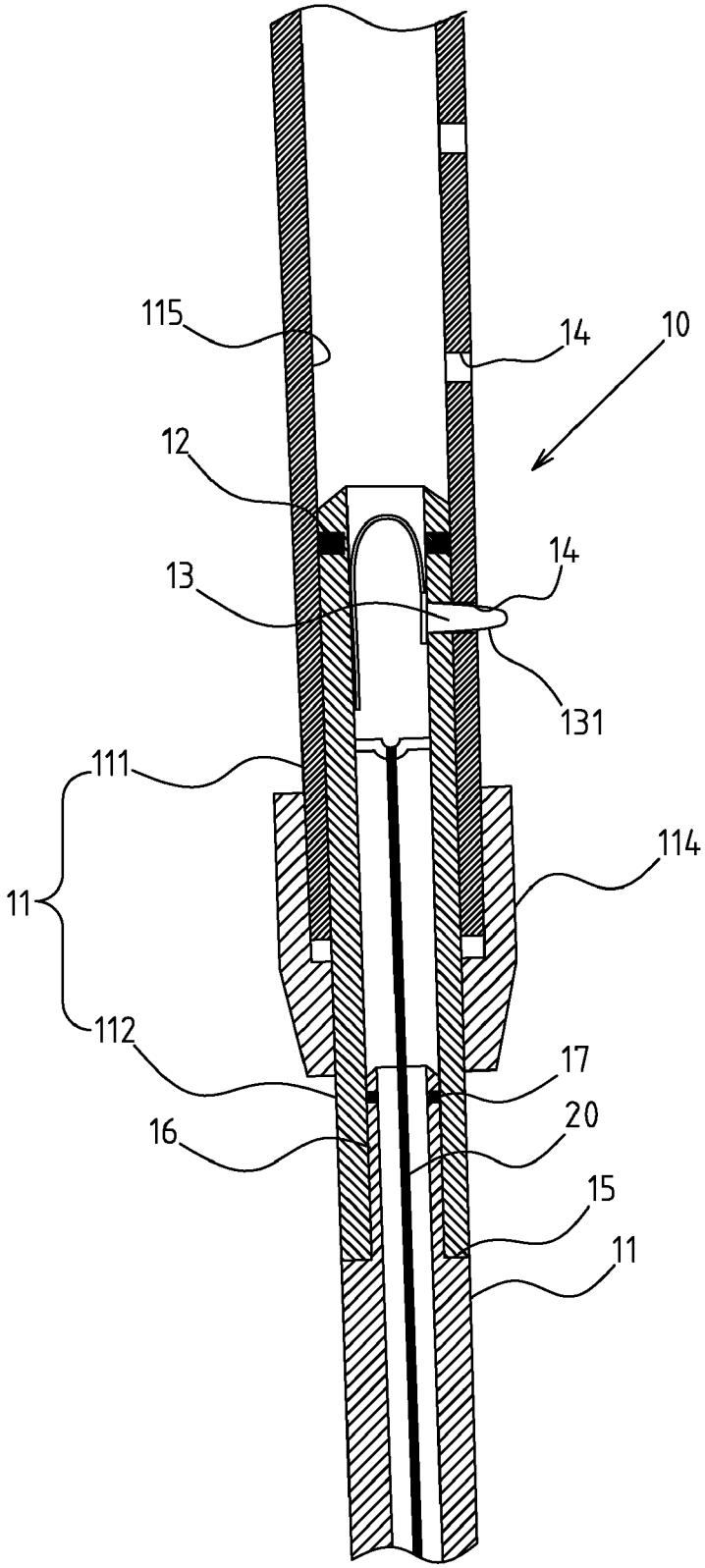
FIG. 2 shows a cross-sectional view of the present invention with adjustable length.

Referring to FIG. 2, a collar 12 is placed on the upper part of the second rod section 112, while a reducing head 114 is arranged around the adapting end of the first rod section 111, so as to grip and squeeze tightly the corresponding portion of the second rod section 112. When the collar 12 is to be sleeved onto the inner wall 115 of the first rod section 111, it is closely attached onto the inner wall 115 such that the first rod section 111 and second rod section 112 are tightly coupled. The reducing head 114 is made of rubber or elastic material, allowing gripping and squeezing of the corresponding portion of the second rod section 112 for an enhanced connection.

Figure 5:
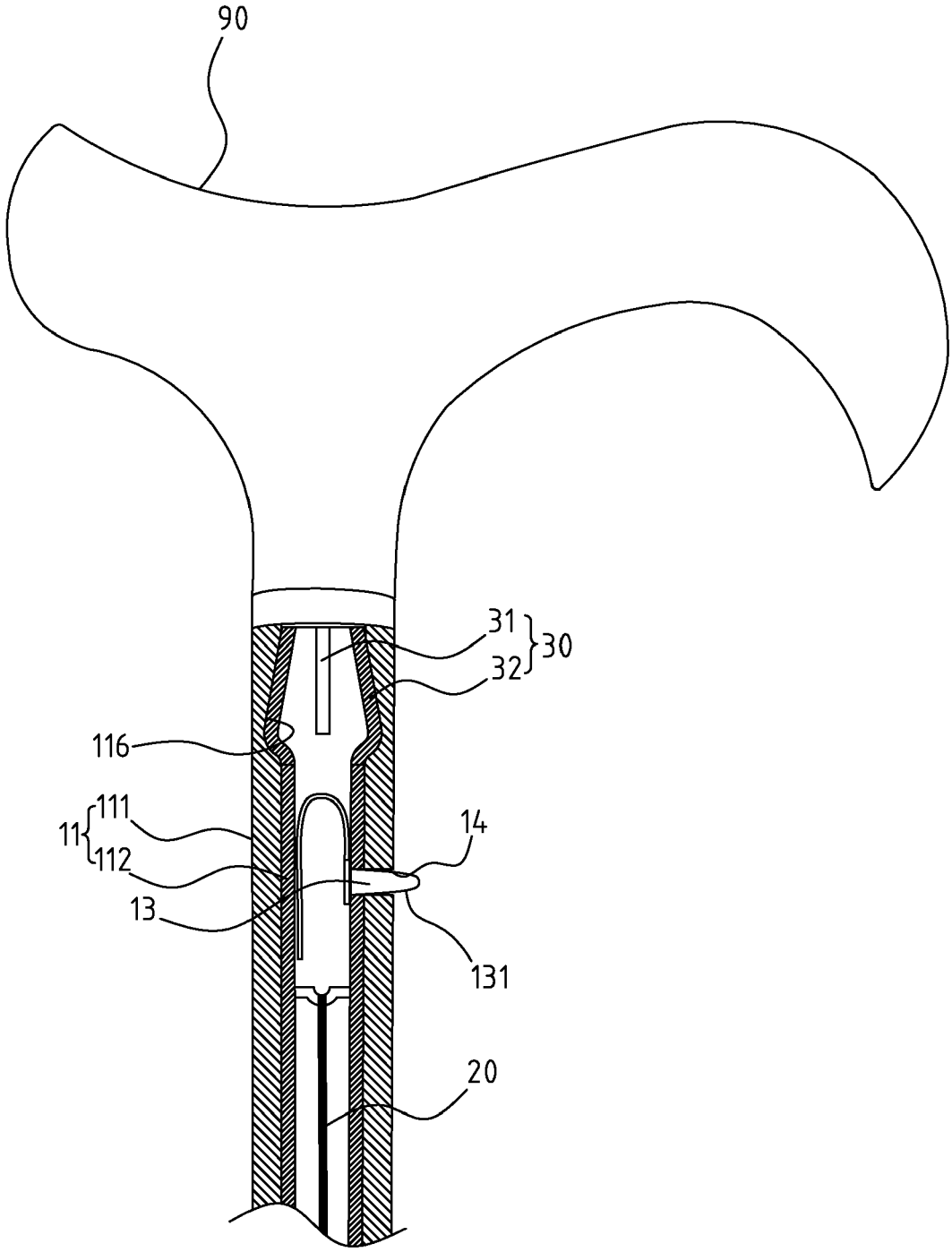
FIG. 5 shows a partial sectional view of another preferred embodiment of the second rod section of the present invention.
Figure 6:
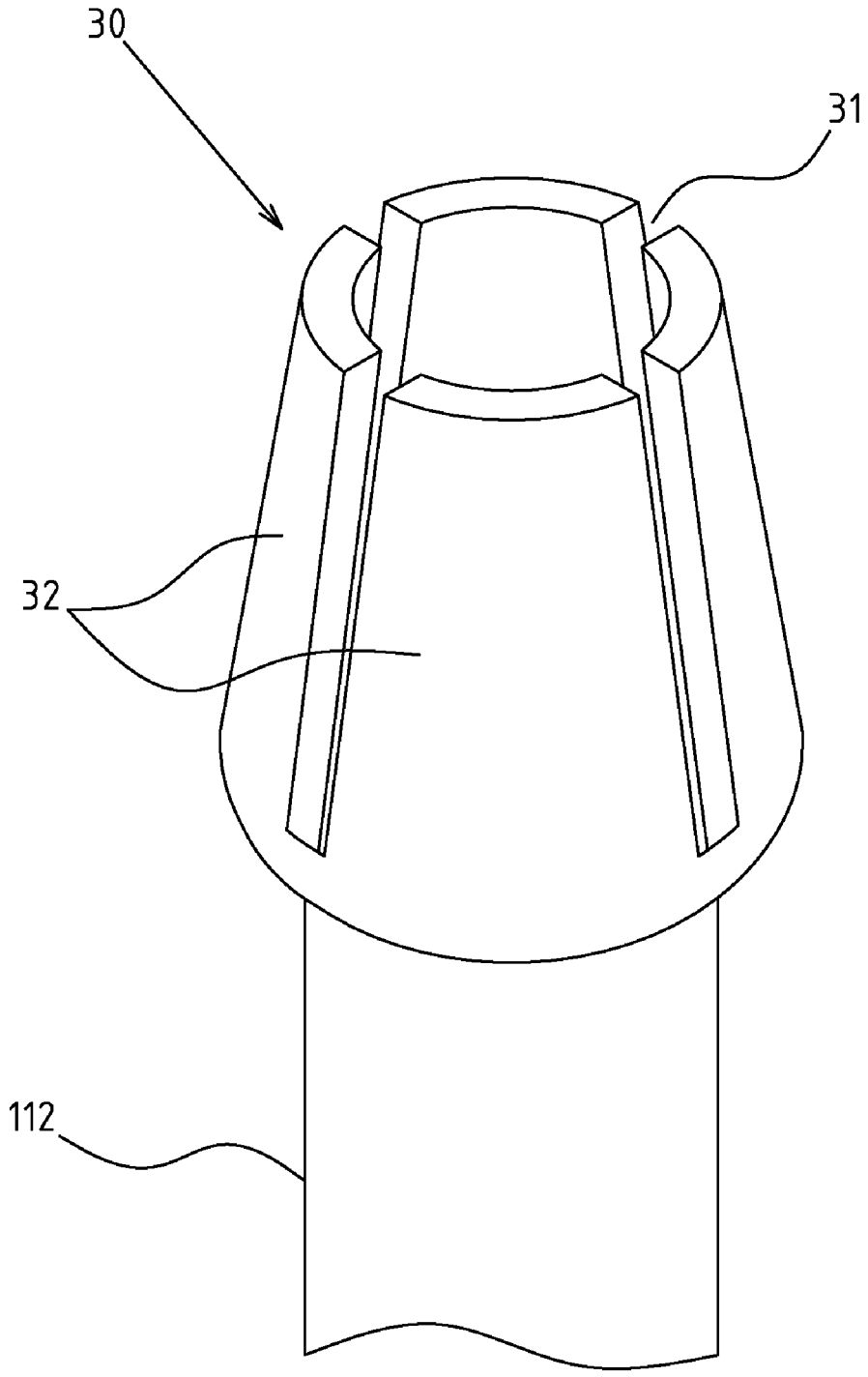
FIG. 6 shows a perspective view of the elastic spacer of the present invention.

Referring to FIGS. 5 and 6, an elastic spacer 30 is arranged integrally on top of the second rod section 112, being stably mated with the first rod section 111 for an improved stability. Moreover, the elastic spacer 30 contains at least a groove 31 and an insert 32, of which the insert 32 is embedded onto the embedding portion 116 of the first rod section 111 for positioning purpose. The elastic spacer 30 may be made of rubber or plastic.

Figure 7:
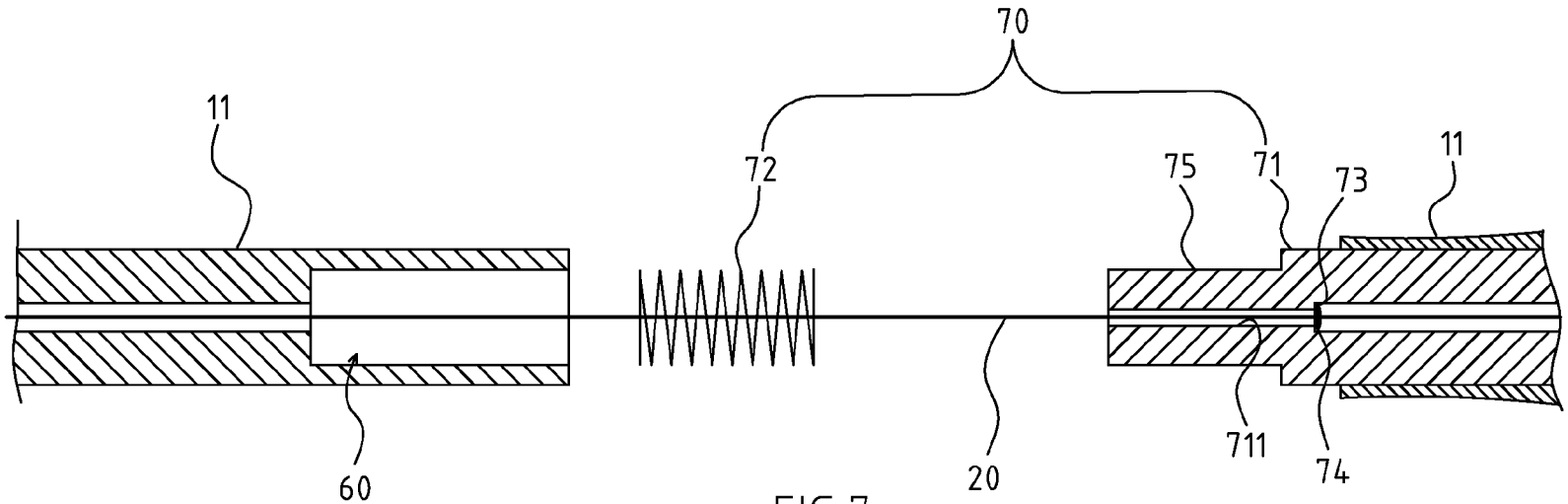
FIG. 7 shows an exploded sectional view of the shock-proofing mechanism of the present invention.
Figure 8:
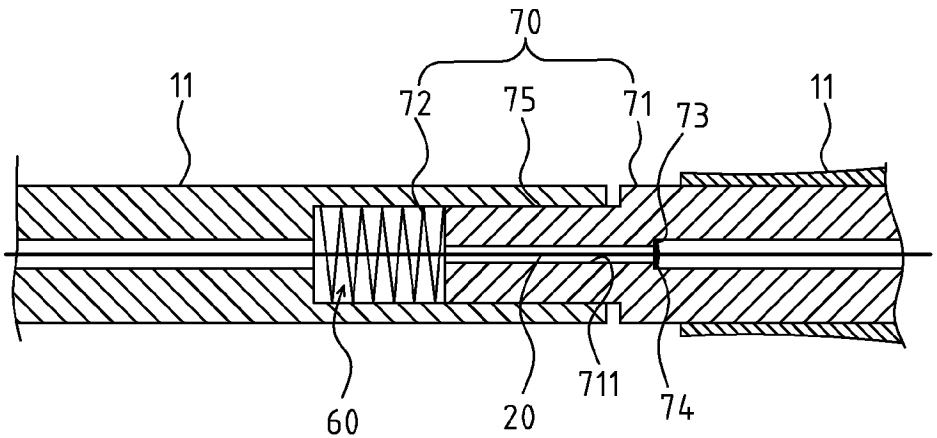
FIG. 8 shows a cross-sectional view of the assembly of the shock-proofing mechanism of the present invention.

Referring to FIGS. 7 and 8, the shock-proofing mechanism 70 comprises a grounding pole 71 and a flexible member 72. The grounding pole 71 is provided with a hollow hole 711, allowing for the penetration and connection of the flexible pulling rope 20. An internal flange 73 is formed within the hollow hole 711, and a protruding snapper 74 is preset on the flexible pulling rope 20 to snap the internal flange 73. A stepped axis 75 of different diameters is shaped at one end of the grounding pole 71, such that when the flexible member 72 is placed into the inner space 60 of the rod 11, one end of the stepped axis 75 of the grounding pole 71 can be squeezed into the flexible member 72 of the inner space 60, so the rod 11 and grounding pole 71 are axially moved via the flexible pulling rope 20.

The tapered locating section 131 of the flexible locating pin 13 is of a tapered shape, while the locating hole 14 of the first rod section 111 is of a round shape.

Based upon above-specified structures, the present invention is operated as follows:

Referring to FIG. 1, the foldable walking stick A is composed of two or more sections of interconnected rods 11, which are pulled and held by the flexible pulling rope 20 that is assembled within the rods 11 to form interconnection between the rods and to enable folding and storing of the foldable walking stick A. In intended operation, the rods 11 are pulled and held by the flexible pulling rope 20 to form a walking stick after interconnection. When not used, the rods 11 are pulled apart by the flexible pulling rope 20 and then folded. For the shock-proofing mechanism 70 within the inner space 60 at preset location of the rod 11, the grounding pole 71 is internally provided with a hollow hole 711. Furthermore, with the pulling and holding of the flexible pulling rope 20, the stepped axis 75 formed at one end of the grounding pole 71 is assembled correspondingly into the inner space 60 of the rod 11, so as to squeeze the flexible member 72 in the inner space 60, thereby realizing the assembly of the foldable walking stick A.

Referring to FIG. 2, a flexible locating pin 13 is radially protruded from the adapting end of the second rod section 112, and a locating hole 14 of different heights is arranged around the wall of the first rod section 111, such that when the second rod section 112 is inserted, the flexible locating pin 13 can be protruded and locked for adjusting the length flexibly, namely, adjusting the length of the stick depending on the sleeved depth of the second rod section 112.

Figure 4:
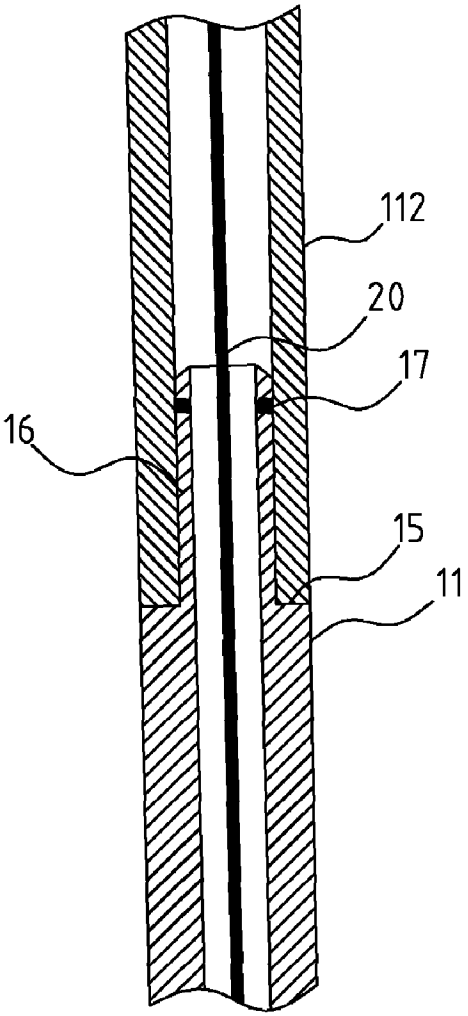
FIG. 4 shows a cross-sectional view of the interconnection of the rods of the present invention.
Figure 3:
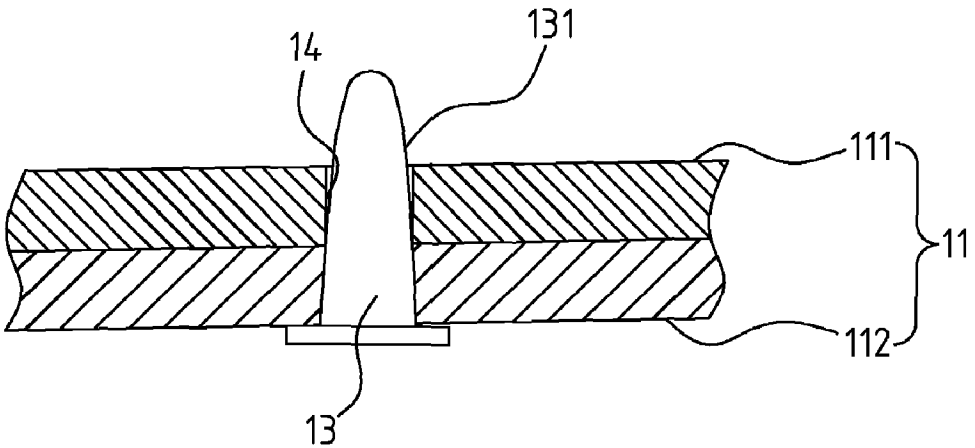
FIG. 3 shows a partially enlarged sectional view of FIG. 2.

Referring to FIGS. 3 and 4, the flexible locating pin 13 of the second rod section 112 is provided with the tapered locating section 131, so the snapping can be achieved by inserting tapered locating section 131 into the locating hole 14 on the first rod section 111. O-ring 17 is placed on the sleeving end of the second rod section 112. When O-ring 17 is sleeved into the first rod section 111, the first and second rod sections 111, 112 are tightly coupled. Moreover, a reducing head 114 is arranged around the adapting end of the first rod section 111, so as to grip and squeeze the corresponding periphery of the second rod section 112.

Figure 9:
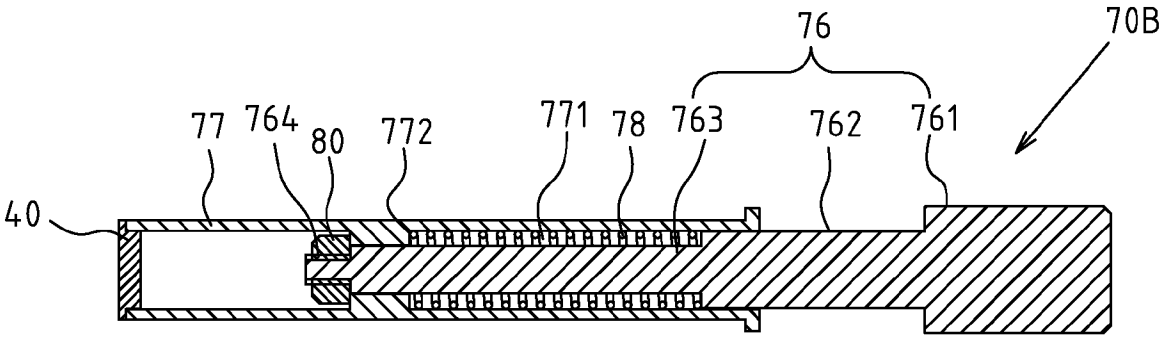
FIG. 9 shows a cross-sectional view of the assembly of another preferred embodiment of the shock-proofing mechanism of the present invention.
Figure 10:
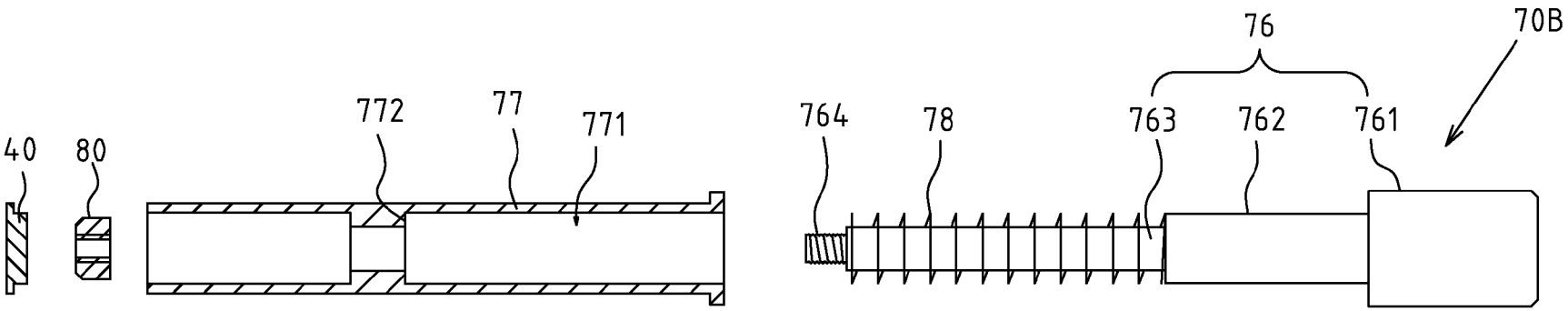
FIG. 10 shows an exploded sectional view of FIG. 9.

Referring to FIG. 9, there is another application view of the shock-proofing mechanism, wherein the shock-proofing mechanism 70B comprises a shock lever 76, a shock tube 77 and a flexible member 78. The shock lever 76 is composed of a flanged adapter 761, a shaft shoulder 762 and a mandrel 763. The shaft shoulder 762 is arranged between the adapter 761 and mandrel 763, while an external threaded section 764 is protruded from the mandrel 763. The shock tube 77 is provided with an internal hollow hole 771, wherein a stop flange 772 is placed in the central section. The mandrel 763 and shaft shoulder 762 of the shock lever 76 are penetrated into the internal hollow hole 771 of the shock tube 77, and bolted via a nut 80 onto the external threaded section 764 of the mandrel 763, thus allowing for snapping onto one side of the stop flange 772. The flexible member 78 is flexibly sleeved onto the mandrel 763, and embedded into the internal hollow hole 771 of the shock tube 77. Moreover, it is located between the shaft shoulder 762 of the shock lever 76 and the stop flange 772 of the shock tube 77, thereby supporting flexibly the shock lever 76 (also referring to FIG. 10).

Figure 11:
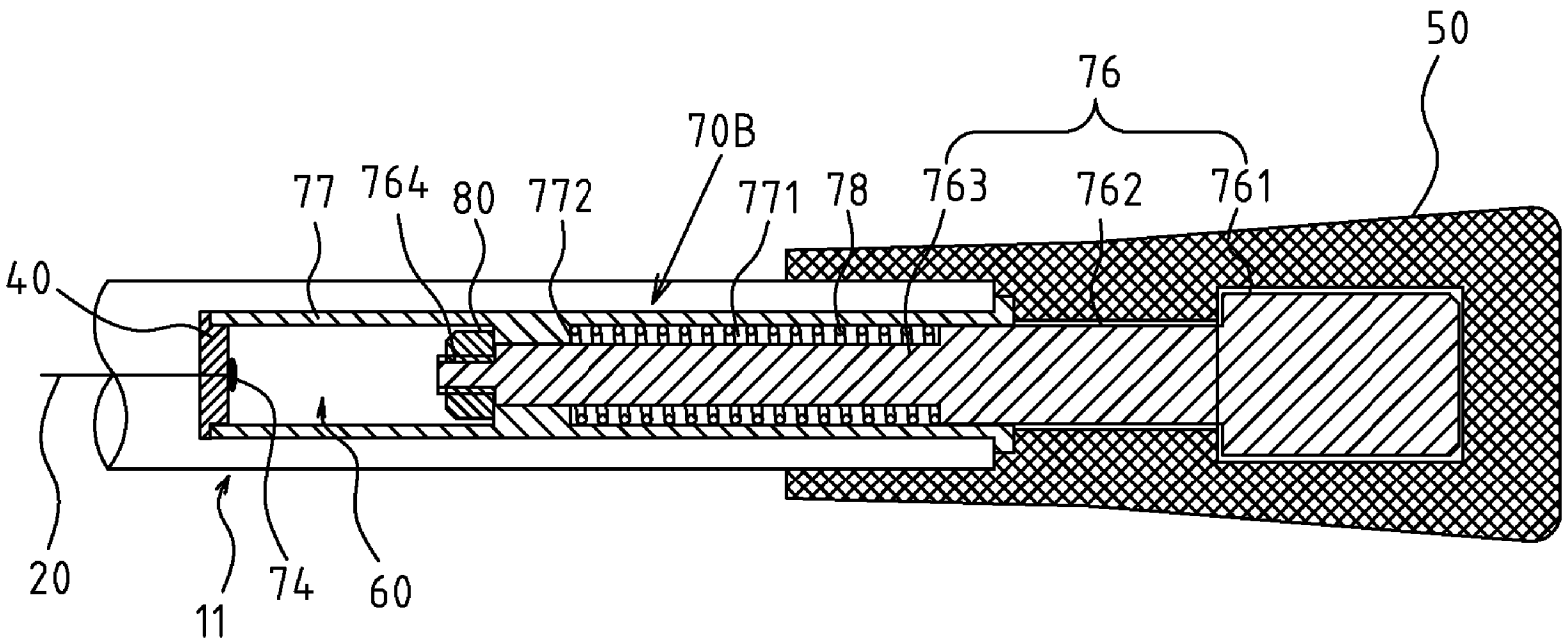
FIG. 11 shows a cross-sectional view of the assembly of the other shock-proofing mechanism and rod of the present invention.

Referring to FIG. 11, the mandrel 763 and the shock lever 76 are coaxially fabricated with higher convenience and processing accuracy. After the nut 80 is used to bolt the external threaded section 764 of the mandrel 763, one end of the rod 11 is covered by a plastic plug 40. Moreover, the shock-proofing mechanism 70B can be embedded into the inner space 60 of the rod 11, then the plastic plug 40 is penetrated by the flexible pulling rope 20, and one end is provided with a protruding snapper 74 for snapping and limitation purpose.

Figure 12:
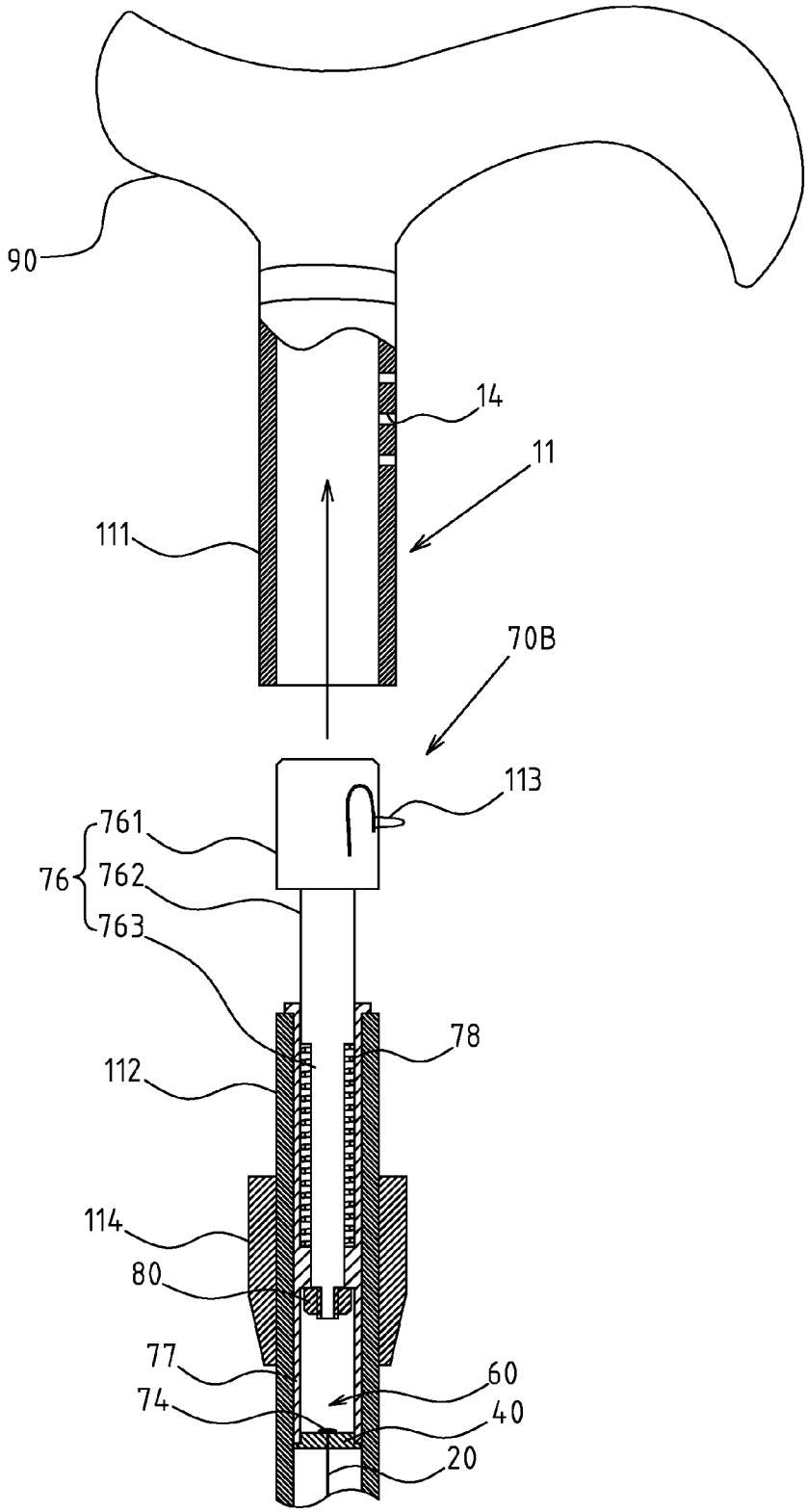
FIG. 12 shows an exploded sectional view of the shock-proofing mechanism and handle of the present invention.

Referring to FIG. 12, an application view that the shock-proofing mechanism 70B is deflected and assembled into the rod 11 connected to the handle 90. The inner space 60 is arranged on the preset location of the rod 11 connected to the handle 90, and the deflected shock-proof mechanism 70B can be assembled onto the second rod section 112 and embedded into the first rod section 111 of the rod 11. The corresponding portion of the second rod section 112 can be gripped by the reducing head 114.

I claim:

1. A foldable stick assembly comprising:

a rod holder having a first rod and a second rod interconnected together;

a handle positioned at an upper portion of said first rod, said first rod having a first rod section and a second rod section;

a flexible pulling rope arranged into said second rod section so as to allow a flexible adjustment of said first rod section and said second rod section;

a flexible locating pin positioned on an adapting end of said second rod section, said flexible locating pin extending in a radially protruding manner;

a plurality of locating holes formed on a wall of said first rod section in spaced relation to each other, said flexible locating pin selectively engageable with at least one of said plurality of locating holes;

a tapered locating section formed on said flexible locating pin, said tapered locating section having an external diameter that increases gradually from an outside thereof, said tapered locating section having a maximum diameter that is greater than a diameter of each of said plurality of locating holes of said first rod section, said flexible locating pin received within the locating hole by a tapered locating section;

a shockproof mechanism affixed in an inner space of said rod holder; and a grounding portion positioned at a bottom of said rod holder, said shockproof mechanism comprising:

a grounding pole having a hollow hole, said hollow hole receiving said flexible pulling rope, said hollow hole having an internal flange formed therein, said flexible pulling rope having a protruding snapper thereon, said protruding snapper suitable for snapping onto said internal flange, said grounding pole having a stepped axis of different diameters at one end thereof; and a flexible member positioned in said inner space of said rod holder, one end of said stepped axis being squeezed into said flexible member such that said flexible pulling rope allowing said rod holder and said grounding pole to be axially movable.

2. The foldable stick assembly of claim 1, said second rod section having a collar in an upper portion thereof, said first rod section having an adapting end with a reducing head arranged therearound so as to grip a corresponding portion of said second rod section.

3. The foldable stick assembly of claim 1, said adapting end of said second rod section being sleeved into an inner wall of said first rod section, said second rod section having a root with a step, said root being braced at an end of said first rod section, said second rod section having an O-ring extending therearound.

4. The foldable stick assembly of claim 1, said second rod section having an elastic spacer positioned at a top thereof, said elastic spacer being mated with said first rod section, said elastic spacer having a groove and an insert, said insert embedded onto said first rod section.

5. A foldable stick assembly comprising:

a rod holder having a first rod and a second rod interconnected together;

a handle positioned at an upper portion of said first rod, said first rod having a first rod section and a second rod section;

a flexible pulling rope arranged into said second rod section so as to allow a flexible adjustment of said first rod section and said second rod section;

a flexible locating pin positioned on an adapting end of said second rod section, said flexible locating pin extending in a radially protruding manner;

a plurality of locating holes formed on a wall of said first rod section in spaced relation to each other, said flexible locating pin selectively engageable with at least one of said plurality of locating holes;

a tapered locating section formed on said flexible locating pin, said tapered locating section having an external diameter that increases gradually from an outside thereof, said tapered locating section having a maximum diameter that is greater than a diameter of each of said plurality of locating holes of said first rod section, said flexible locating pin received within the locating hole by a tapered locating section;

a shockproof mechanism affixed in an inner space of said rod holder; and a grounding portion positioned at a bottom of said rod holder, said shockproof mechanism comprising:

a shock lever having a flexible adapter and a shaft shoulder and a mandrel, said mandrel having an external threaded section protruding therefrom, said shaft shoulder arranged between said flanged adapter and said mandrel;

a shock tube having an internal hollow hole and a stop flanged positioned in a central section of said shock tube, said mandrel and said shaft shoulder of said shock lever arc positioned into said internal hollow hole and bolted by a nut onto said external threaded section of said mandrel so as to allow for a snapping onto one side of said stop flange; and a flexible member flexibly sleeved onto said mandrel and embedded into said internal hollow hole of said shock tube, said flexible member being located between said shaft shoulder of said shock lever and said stop flange of said shock tube.

6. The foldable stick assembly of claim 5, said tapered locating section of said flexible locating pin being of a tapered shape, the locating holes of said first rod section being of a round shape.

* * * * *